US006701546B2

(12) United States Patent
Hodgetts

(10) Patent No.: US 6,701,546 B2
(45) **Date of Patent: *Mar. 9, 2004**

(54) PATIENT TRANSPORT SYSTEM

(75) Inventor: Graham L. Hodgetts, Baden, PA (US)

(73) Assignee: Barton Medical Corporation, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/945,157

(22) Filed: Aug. 31, 2001

(65) Prior Publication Data

US 2002/0170110 A1 Nov. 21, 2002

Related U.S. Application Data

(63) Continuation of application No. PCT/US00/05446, filed on Mar. 3, 2000, which is a continuation-in-part of application No. 08/440,065, filed on May 12, 1995, now Pat. No. 5,697,109, and a continuation-in-part of application No. 08/330,808, filed on Oct. 28, 1994, now Pat. No. 5,819,339.

(60) Provisional application No. 60/122,946, filed on Mar. 5, 1999.

(51) Int. Cl.[7] ..... A61G 7/08

(52) U.S. Cl. ..... 5/88.1; 5/81.1 R; 5/81.1 HS

(58) Field of Search ..... 5/86.1, 81.1 R, 5/88.1, 89.1, 84.1, 87.1 C, 87.1 HB

(56) References Cited

U.S. PATENT DOCUMENTS

| | | | | |
|---|---|---|---|---|
| 378,220 | A | 2/1888 | Staples et al. | |
| 716,886 | A | 12/1902 | Goode | |
| 1,263,611 | A | 4/1918 | Scroggin | |
| 1,487,171 | A | 3/1924 | La Vigne | |
| 2,093,231 | A | 9/1937 | Broadwell | 24/245 |
| 2,439,066 | A | 4/1948 | Vanderlyn | 5/88.1 |
| 2,487,648 | A | 11/1949 | Green | 248/267 |
| 2,536,707 | A | 1/1951 | Allyn | 5/85 |
| 2,630,583 | A | 3/1953 | Gilleland | 5/81 |
| 2,632,619 | A | 3/1953 | Wilson | 248/201 |
| 2,665,432 | A | 1/1954 | Butler | |
| 2,733,452 | A | 2/1956 | Tanney | 5/81 |
| 2,783,053 | A | 2/1957 | Sheldrick et al. | |
| 2,827,642 | A | 3/1958 | Huff | |
| 2,939,195 | A | 6/1960 | Carlson | 24/245 |
| 3,108,290 | A | 10/1963 | Partridge | |
| 3,140,069 | A | 7/1964 | McBurney et al. | 248/201 |
| 3,165,760 | A | 1/1965 | Abajian | |
| 2,745,163 | A | 5/1965 | Buren, Jr. | 24/346 |
| 3,294,247 | A | 12/1966 | Norrington | 248/201 |
| 3,302,219 | A | 2/1967 | Harris | 5/85 |
| 3,413,663 | A | 12/1968 | Swann | 5/81 |
| 3,593,351 | A | 7/1971 | Dove | 5/81 |
| 3,618,968 | A | 11/1971 | Greer | |
| 3,709,556 | A | 1/1973 | Allard et al. | 248/125 |
| 3,769,642 | A | 11/1973 | Warman | 5/81 |
| 3,775,784 | A | 12/1973 | Fry | 5/81 |
| 3,794,313 | A | 2/1974 | Berger et al. | 269/322 |

(List continued on next page.)

FOREIGN PATENT DOCUMENTS

| | | |
|---|---|---|
| AT | 6818 | 4/1984 |
| GB | 26017 | 11/1907 |
| GB | 10012 | 4/1909 |
| WO | 00221 | 1/1986 |

*Primary Examiner*—Frederick L. Lagman
(74) *Attorney, Agent, or Firm*—Webb Ziesenheim Logsdon Orkin & Hanson, P.C.

(57) ABSTRACT

A wheelchair convertible into a gurney that includes a main frame, a rear frame and a supplemental rear frame pivotally secured to the rear frame. The main frame includes a back portion pivotally secured to a seat portion which is pivotally secured to a leg portion. The rear frame is pivotally secured to the back portion. A guide arrangement is provided that coacts with the supplemental rear frame and the main frame whereby the main frame is in a first position. The back portion, seat portion and leg portion are arranged so that they are in different planes and when the main frame is in a second position, the back portion, seat portion and leg portion are arranged so that they are in a gurney position.

4 Claims, 11 Drawing Sheets

U.S. PATENT DOCUMENTS 3,810,263 A 5/1974 Taylor et al. ..... 5/81
3,848,784 A 11/1974 Baxter ..... 211/60.1
3,848,786 A 11/1974 Baxter ..... 248/73
3,924,281 A 12/1975 Gibbs ..... 5/88.1
4,068,770 A 1/1978 Boehringer ..... 214/85
4,270,234 A 6/1981 James ..... 5/88.1
4,339,013 A 7/1982 Weigt
4,403,641 A 9/1983 Reeder ..... 160/238
4,416,511 A 11/1983 Weinberg ..... 160/238
4,453,732 A 6/1984 Assanah et al.
4,502,169 A 3/1985 Persson ..... 5/88.1
4,660,240 A 4/1987 Hutton ..... 5/498
4,679,259 A 7/1987 DiMatteo et al. ..... 5/81.1
4,681,279 A 7/1987 Nakamura ..... 160/294
4,686,748 A 8/1987 Kaivanto ..... 24/522
4,688,304 A 8/1987 Marcott ..... 24/459
4,696,025 A 9/1987 Taylor ..... 378/146
4,747,170 A 5/1988 Knouse ..... 5/81
4,761,841 A 8/1988 Larsen ..... 5/81
4,776,047 A 10/1988 DiMatteo ..... 5/81
4,786,064 A 11/1988 Baghdasarian
4,787,104 A 11/1988 Grantham ..... 5/66
4,837,873 A 6/1989 DiMatteo et al. ..... 5/81.1
4,868,938 A 9/1989 Knouse ..... 5/88.1
4,947,418 A 8/1990 Barr et al. ..... 378/177
4,970,738 A 11/1990 Cole ..... 5/81.13
5,022,810 A 6/1991 Sherrow et al. ..... 414/501
5,033,132 A 7/1991 Greenblatt ..... 160/238
5,033,170 A 7/1991 Ewert ..... 24/459
5,038,424 A 8/1991 Carter et al. ..... 5/81
5,050,899 A 9/1991 Stensby
5,152,486 A 10/1992 Kabanek et al. ..... 248/201
5,161,276 A 11/1992 Hutton et al. ..... 5/498
5,163,189 A 11/1992 DeGray ..... 5/86.1
5,213,580 A 5/1993 Slepian et al. ..... 623/1
5,236,390 A 8/1993 Young ..... 454/95
5,271,110 A * 12/1993 Newman ..... 5/81.1 R
5,279,010 A 1/1994 Ferrand et al. ..... 5/600
5,294,141 A 3/1994 Mentessi et al.
5,333,887 A 8/1994 Luther
5,340,266 A 8/1994 Hodgetts ..... 414/527
5,353,453 A 10/1994 Naumann ..... 5/417
5,435,323 A 7/1995 Rudy ..... 5/628
5,544,371 A 8/1996 Fuller ..... 5/88.1
5,697,109 A 12/1997 Hodgetts
5,819,339 A * 10/1998 Hodgetts ..... 5/88.1
5,996,144 A * 12/1999 Hodgetts ..... 5/81.1 R
6,289,533 B1 * 9/2001 Hodgetts ..... 5/81.1 R
6,507,963 B2 * 1/2003 Hodgetts ..... 5/81.1 R

* cited by examiner

PATIENT TRANSPORT SYSTEM

CROSS REFERENCE TO RELATED APPLICATIONS

This application is a continuation of International Patent Application Number PCT/US00/05446, filed Mar. 3, 2000, and designating, inter alia, the United States, which is a continuation-in-part of U.S. patent application Ser. No. 08/440,065, filed May 12, 1995 now U.S. Pat. No. 5,697,109, granted Dec. 16, 1997, which is a continuation-in-part of U.S. patent application Ser. No. 08/330,808, filed Oct. 28, 1994, now U.S. Pat. No. 5,819,339, granted Oct. 13, 1998. This application also claims the benefit of provisional application No. 60/122,946 filed Mar. 5, 1999.

BACKGROUND OF THE INVENTION

1. Field of the Invention

This invention relates to a wheelchair, and more particularly, to a wheelchair that is convertible into a gurney for transferring an immobile patient from a bed to a gurney or vice versa.

2. Description of the Prior Art

It appears to be widely accepted that a major, if not the major, work-related complaint among nurses and hospital nursing staff is back injury caused by lifting patients and getting them in and out of a bed and to and from a gurney or a stretcher, as it is commonly referred to. This is also true with transferring a patient from a wheelchair into a bed. Although the prior art includes wheelchairs that are convertible into gurneys, several problems exist when those patients must be moved from the bed to the gurney and vice versa. These problems include back injuries caused by lifting the patients and getting up in and out of the bed from the gurney and vice versa.

Therefore, it is an object of this invention to provide a wheelchair that is convertible into a gurney so that a patient may easily be transferred from a bed to the gurney and vice versa.

SUMMARY OF THE INVENTION

The present invention is a wheelchair convertible into a gurney that includes a main frame, having a back portion, seat portion and a leg portion. The back portion is pivotally connected to the seat portion, and the seat portion is pivotally connected to the leg portion. The seat portion has a front portion and a rear portion, wherein the back portion is positioned adjacent the rear portion and the leg portion adjacent the front portion. A back support is attached to the back portion. A seat support is attached to the seat portion, and a leg support is attached to the leg portion. A rear frame is pivotally secured to the back portion, and a supplemental frame is pivotally secured to the rear frame. A plurality of front wheels is secured to the seat portion, and a plurality of rear wheels is secured to the supplemental frame. A longitudinally-extending guide rod having two ends is provided. One end attaches to the supplemental rear frame, and the other end extends toward the leg portion. A guide is attached to the seat portion. The guide rod slidably passes through the guide. The guide is positioned between the two ends of the guide rod. When the main frame is in a first position, the back portion, the seat portion and the leg portion are arranged so the portions of the back support, seat support and leg support are arranged in different planes. When the main frame is in a second position, by pivoting the back portion in the downwardly direction and pivoting the leg portion in an upwardly direction, portions of the back support, seat support and leg support are in a gurney position.

DESCRIPTION OF THE PREFERRED EMBODIMENT

Figure 2:
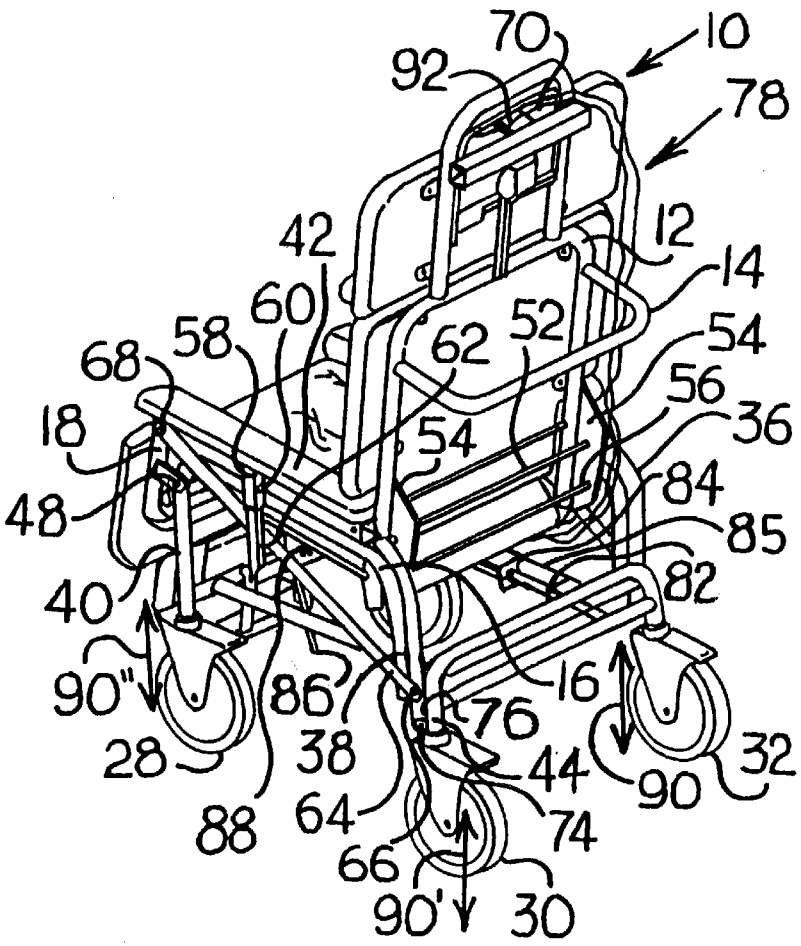
FIG. 2 is a top perspective view of a rear portion of the wheelchair shown in FIG. 1.
Figure 1:
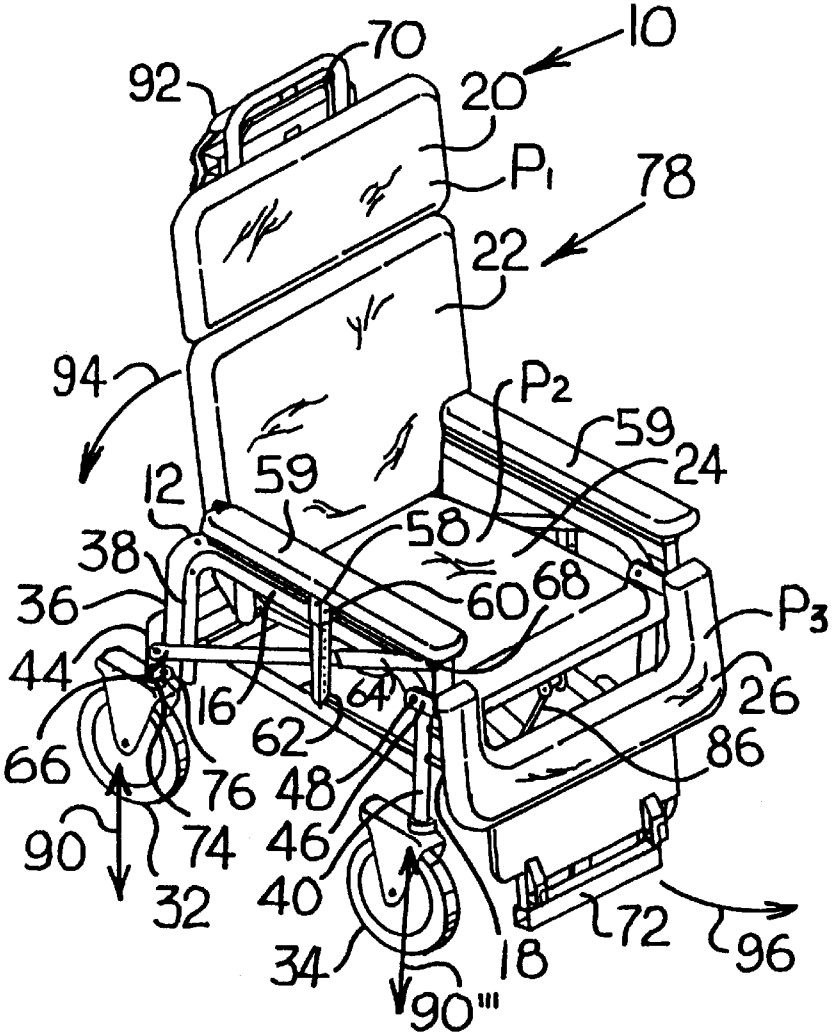
FIG. 1 is a top perspective view of a wheelchair that is convertible into a gurney made in accordance with the present invention in a chair position.

FIGS. 1–7 show a wheelchair convertible into a gurney, hereinafter referred to as a wheelchair/gurney 10, made in accordance with the present invention. Referring specifically to FIGS. 1–4, the wheelchair/gurney 10 includes a convertible frame or main frame 12 that has a back portion 14, which is pivotally connected to a seat portion 16, which is pivotally connected to a leg portion 18. The back portion 14, seat portion 16 and leg portion 18 are adapted to move relative to each other as will be explained below. A head rest pad 20 and seat back pad 22 are secured to the back portion 14. A seat pad 24 is attached to the seat portion 16. A leg rest pad 26 is attached to the leg portion 18. Portions of the head rest pad 20, seat back pad 22, seat pad 24 and leg rest pad 26 are arranged in separate planes $P_1$, $P_2$ and $P_3$. Casters 28, 30, 32, 34 are secured to the lower portions of the convertible frame 12. The casters 28, 30, 32, 34 are adapted to rotate or pivot about longitudinal axes 90, 90', 90" and 90'", respectively.

Further, the convertible frame 12 includes a rear frame 36, arm frames 42 and a supplemental rear frame 44. The seat portion 16 includes a rear portion 38 and a front portion 40. First members 46 are provided on opposite sides of the leg portion 18 pivotally securing the leg portion 18 to the front frame 40 through pivot pins 48. The pivot pins 48 pivotally secure an end of each first member 46 to the front portion 40 of the seat portion 16. The opposite end of each first member 46 is rigidly secured to the leg portion 18. The rear frame 36 is pivotally secured to the back portion 14 through a pivot rod 52. The pivot rod 52 passes through plates 54 rigidly secured to the back portion 14. A pivot member or pivot rod 56 is secured to the rear portion 38 of the seat portion 12, and passes through a portion of the plates 54 so that seat portion 12 is pivotally secured to the back portion 14. Posts 58 are attached to respective arm frames 42. Posts 58 extend transverse to the respective arm rests 59. Lockpins 60 are provided and cooperate with the posts 58 to permit vertical adjustment of the arm rests 59. Receiving posts 62 are provided and rigidly secured to a mid portion of the seat portion 16. The post 58 is slidably received by receiving post 62. Depressing the lockpins 60 permits vertical adjustment of arm rests 59. Linkage arms 64 are provided. Each linkage arm 64 is pivotally secured at one end to the rear frame 36 through a pivot pin 66 and pivotally secured at an opposite end to the leg portion 18 through a pivot pin 68. A head bracket 70 is secured to the back portion 14 and a foot bracket 72 is secured to the leg portion 18. These brackets 70 and 72 are substantially square cross-sectional shape tubing adapted to receive posts of a patient transport system which will be described hereinbelow.

Lugs 74 are fixedly attached to opposite sides of the supplemental rear frame 44. The lugs 74 are pivotally secured at one end through pivot pins 76 to the rear frame 36. The lugs 74 extend along longitudinal axes X' and X" which are substantially transverse to a plane P containing the supplemental rear frame 44. In this arrangement, lugs 74 longitudinally space the rear frame 36 from the supplemental rear frame 44. Casters 30 and 32 are pivotally secured to arms of the supplemental rear frame 44.

A guide rod 82 is provided having two ends where one end rigidly attaches to the supplemental rear frame 44. The guide rod 82 slidably passes through a guide 84 which is fixedly attached to a frame member 85 of the seat portion 16. The other end of the guide rod 82 extends toward the leg portion 18. A support rod 86 is provided having one end secured to the leg portion 18 and slidably received by a guide block 88. The guide block 88 is coupled to a hand brake 92 positioned on the back portion 14. The hand brake 92, when activated or squeezed by an operator, permits the support rod 86 to pass through the guide block 88. When the brake 92 is deactivated or released by an operator, the brake 92 prevents the rod 86 from passing through the guide block 88.

Figure 3:
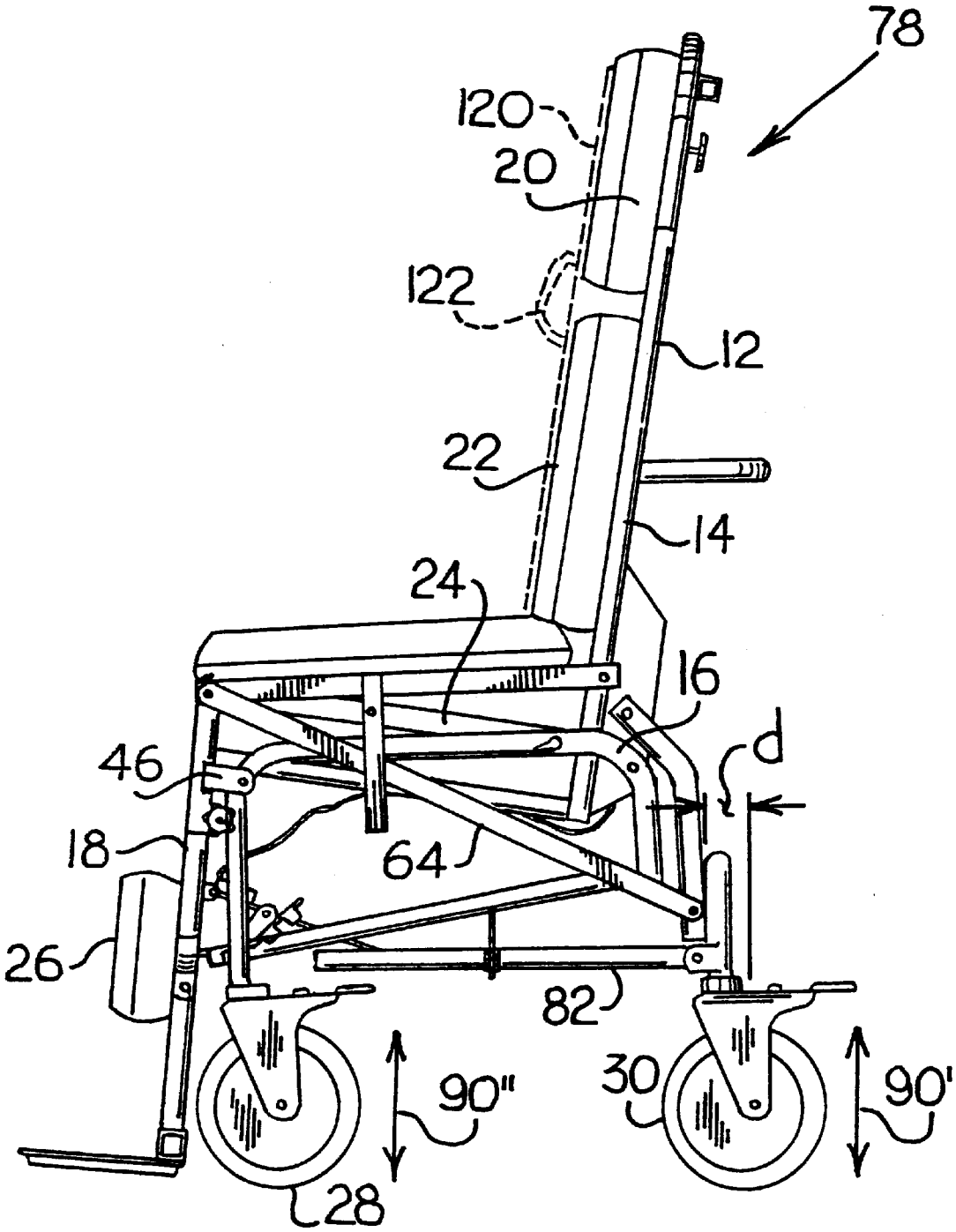
FIG. 3 is a side elevational view of the wheelchair shown in FIGS. 1 and 2.
Figure 4:
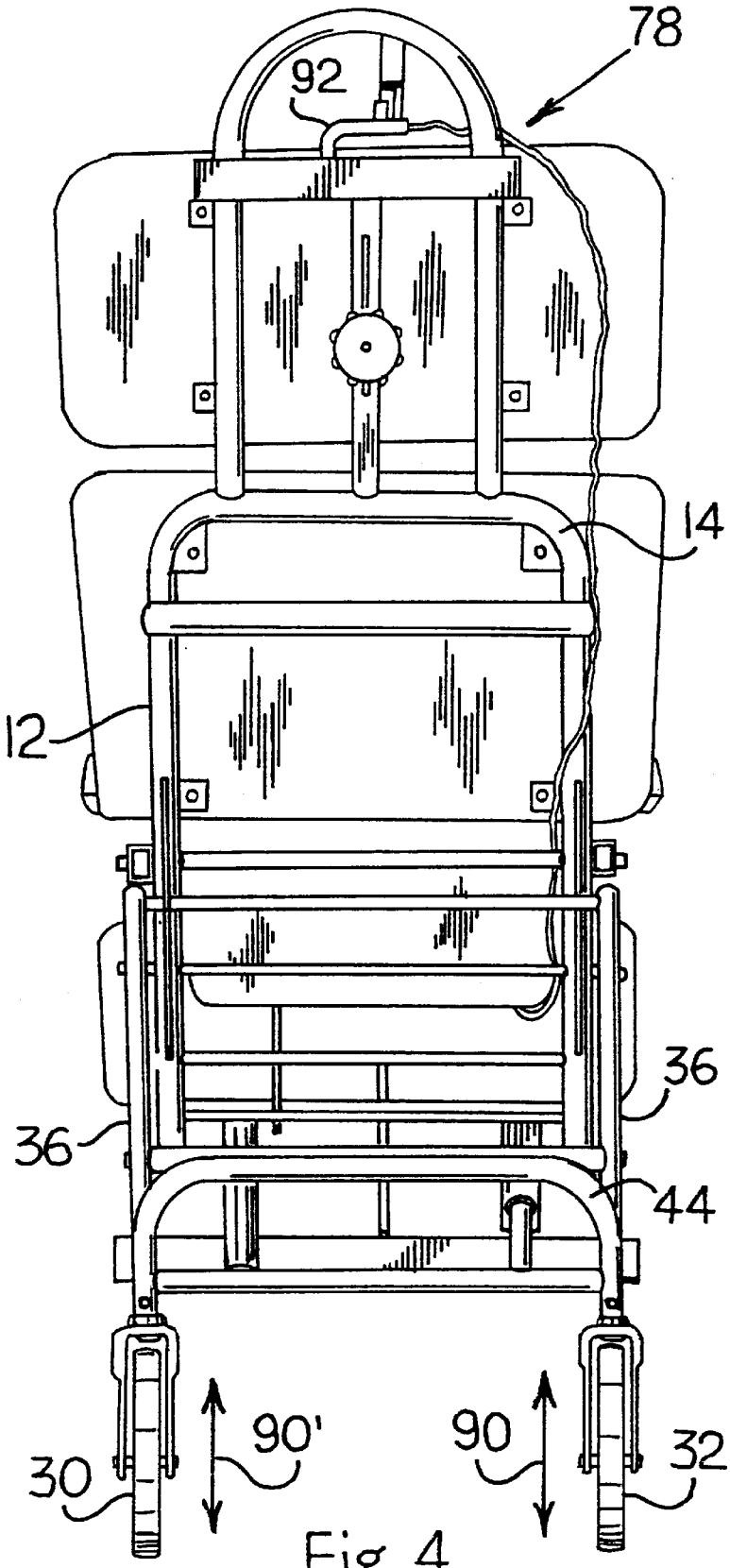
FIG. 4 is a rear elevational view of the wheelchair shown in FIGS. 1–3.
Figure 5:
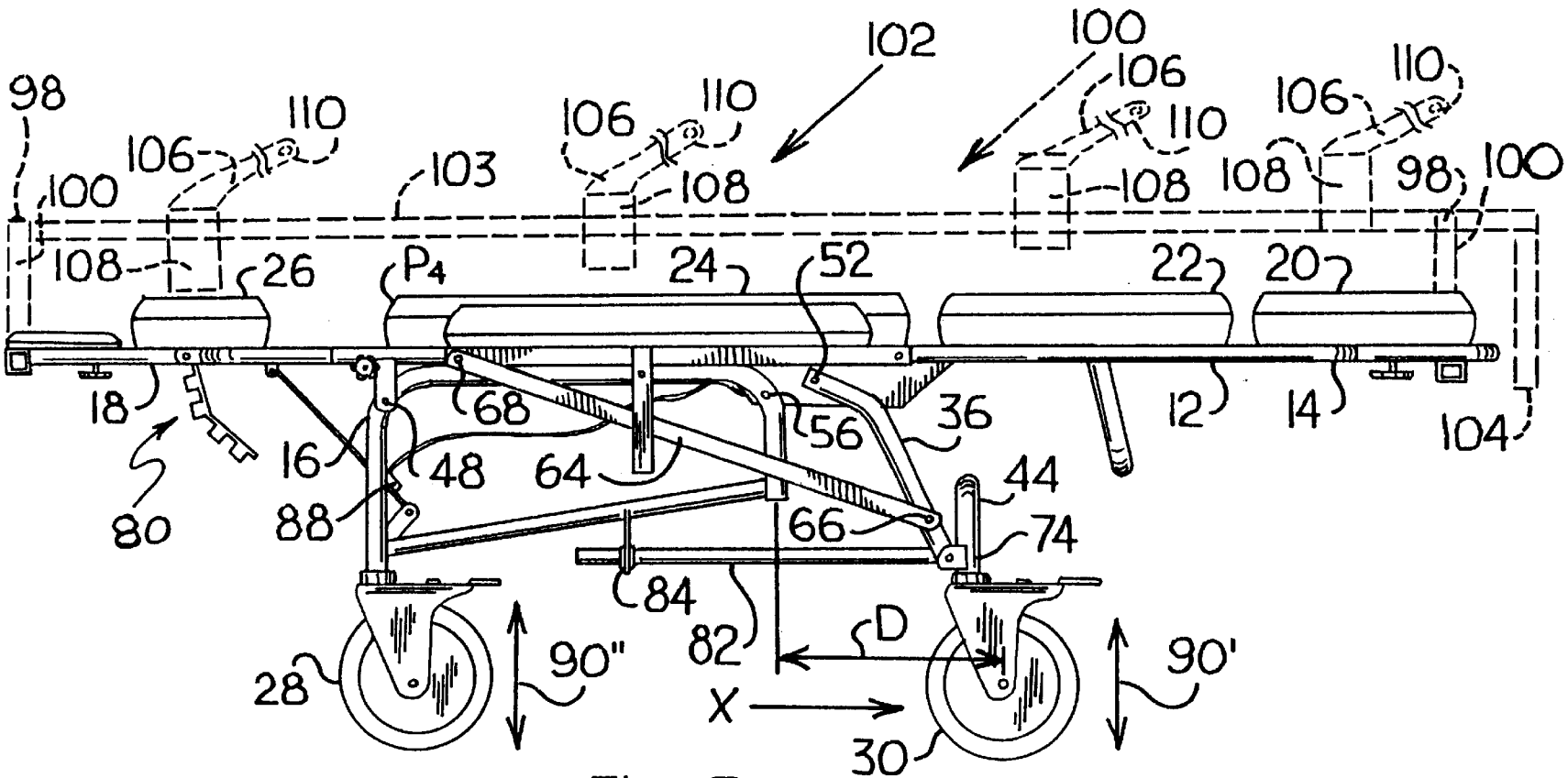
FIG. 5 is a side elevational view of the wheelchair that is convertible into a gurney shown in FIG. 1 in a gurney position with the patient transport system affixed thereto and shown in phantom.
Figure 6:
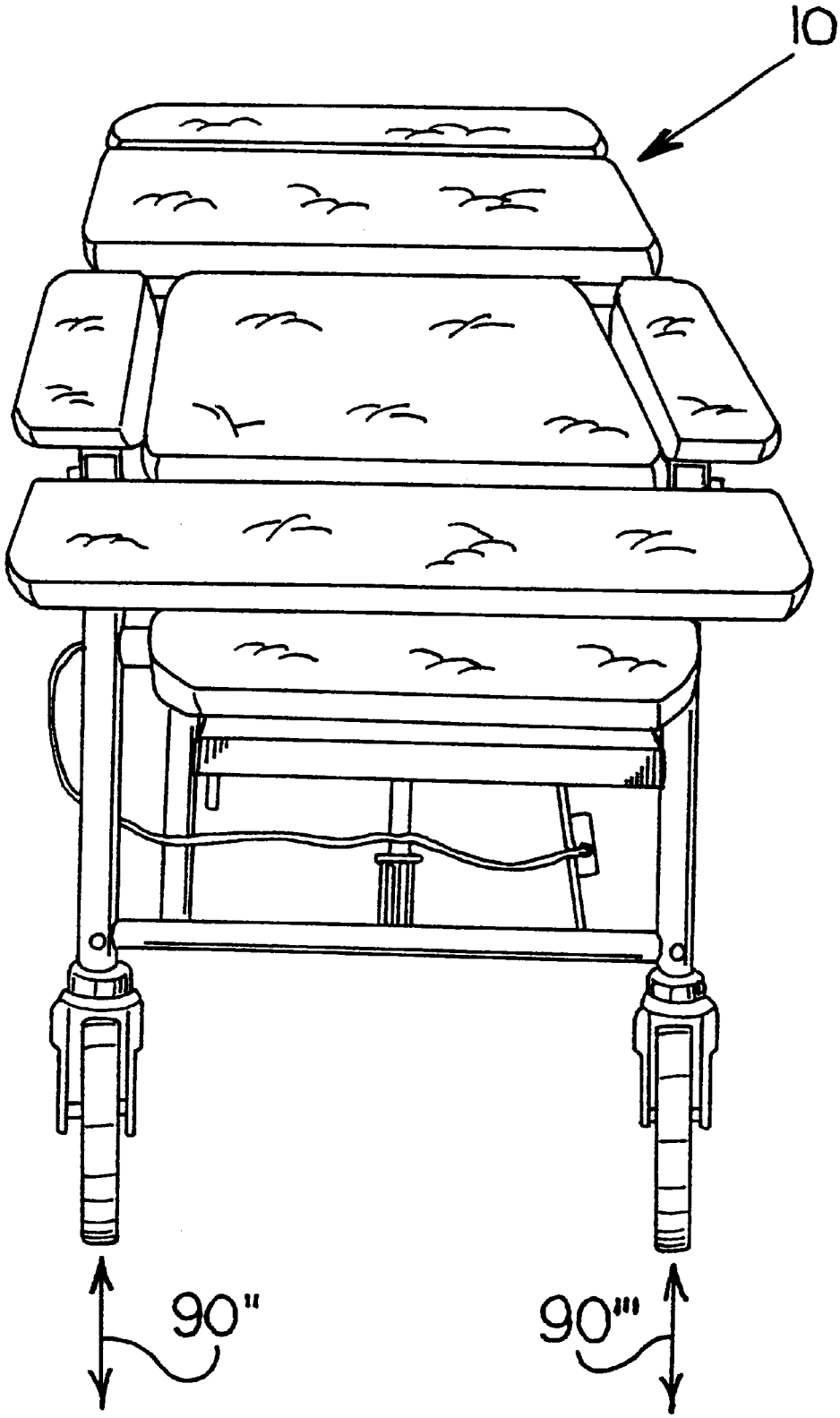
FIG. 6 is an end top perspective view of the wheelchair in the gurney position shown in FIG. 5.
Figure 7:
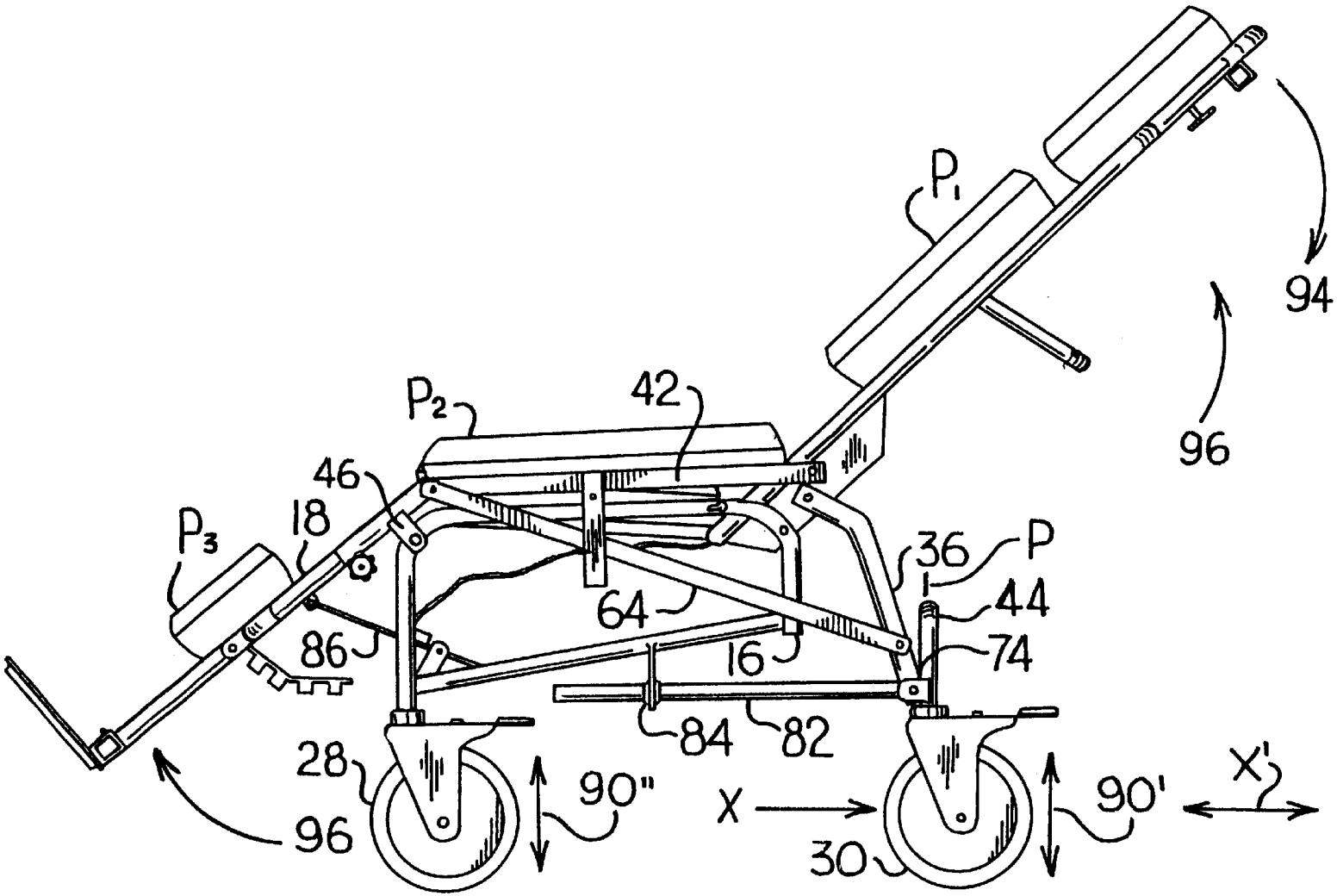
FIG. 7 is a side elevational view of the wheelchair shown in FIG. 1 in an intermediate position.
Figure 8:
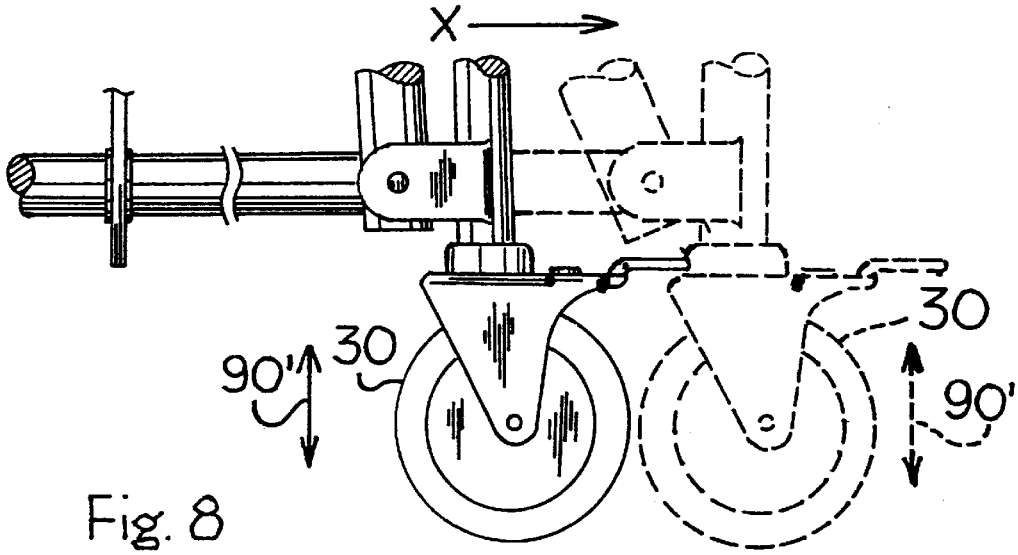
FIG. 8 is a side elevational view of a portion of the wheelchair shown in FIG. 1.
Figure 9:
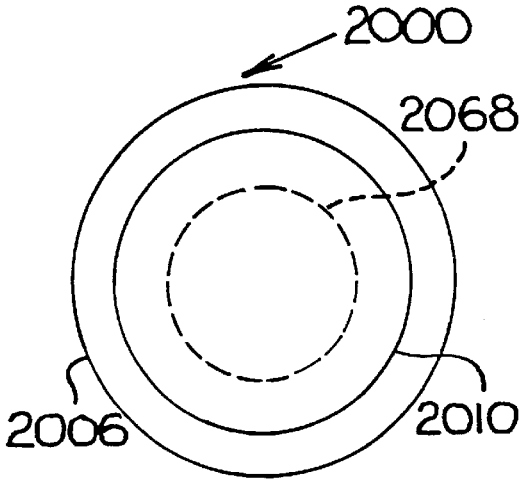
FIG. 9 is a top view of a plug made in accordance with the present invention.
Figure 10:
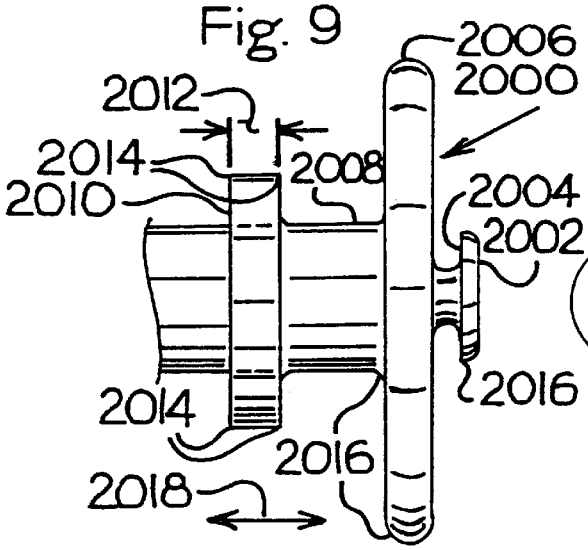
FIG. 10 is a side view of the plug shown in FIG. 9.

Operation of the wheelchair/gurney 10 will now be discussed. Referring to FIGS. 1–4, the wheelchair gurney 10, particularly the main frame 12, is in the chair position or first position 78. To change the position of the wheelchair/gurney 10, the brake 92 is activated and the back portion 14 is pivoted in a downwardly direction 94 as shown in FIG. 7. This then causes the leg portion 18 to move in an upwardly direction 96. This in turn causes the rear wheels 30 and 32 and the guide rod 82 to move rearwardly relative to the seat portion 16 and the front wheels 28 and 34 and the guide 84 in the X direction along a longitudinal axis X' as shown in FIGS. 5, 7 and 8. Likewise, the guide rod 82 is moved in the X direction through the guide 84. The rear wheels 30 and 32 are maintained in a upright position or vertical position by the guide rod 82 and guide 84 while changing positions of the wheelchair/gurney 10. Further, the guide rod 82 coacting with the seat frame 16 and the supplemental rear frame 44 prevents pivoting of the supplemental rear frame 44 relative to the seat frame 16. As can be seen in FIG. 5, the rear portion 38 of the seat portion 16 is spaced a distance D from the axes 90 and 90' when the wheelchair/gurney 10, particularly the main frame 12, is in the gurney position 80. As shown in FIG. 3, the rear portion 38 of the seat portion 16 is spaced a distance d from the axes 90 and 90' when the wheelchair/gurney 10 is in the chair position 78, where d is less than D. Further, during movement to the second position 80, the rear frame 36 pivots relative to the supplemental rear frame 44 and the back portion 14 and linkage arm 64 moves relative to the leg portion 18 and the rear frame 36. Furthermore, the first members 46 pivot relative to the front portion 40 of the seat portion 16. Hence, portions of the headrest pad 20, seat back pad 22, seat pad 24 and leg rest pad 26 are in a gurney position, such as being contained in substantially a plane $P_4$, as shown in FIG. 5, enabling a patient to be in a flat lying position. The arm frames 42 can then be moved downwardly by activating the lockpins 60 so that they also are substantially in the plane $P_4$.

As shown in phantom in FIG. 7, posts 98 can be received by the brackets 70 and 72 which have receiving bearings 99 to receive a patient transport device 100 such as that shown in U.S. Pat. No. 5,996,144 and International Application No. WO 99/30662, which are hereby incorporated by reference. The patient transport device 100 is used in transferring a patient from a bed to a gurney and includes a conveyor 102 having a roller 103 removably secured to the convertible frame 12 through the posts 98 and the receiving bearings. A handle 104 is secured to the roller 103 and a plurality of flexible straps 106 are attached to the roller 103 by longitudinally slidable sleeves 108. Clips 110 are provided on ends of the straps 106 to be secured to a sheet 120. FIG. 3 shows a sheet 120 having a plurality of loops 122 that coact directly with the straps 106. A similar post and bearing arrangement can be provided on a bed or another gurney for moving the patient from the wheelchair, in the gurney position 80, to the bed. After the patient is either moved off the wheelchair/gurney 10 in the gurney position 80, or vice versa, if present, the posts 98, the bearing blocks 99 and the patient transport device 100 are removed. The brake 92 can be activated and the back portion 14 of the convertible frame 12 is moved in an opposite or upwardly direction 96 thereby moving the convertible frame 12 into a wheelchair position 78. The brake 92 provides a lock to maintain the chair in the first position 78 or second position 80.

An important aspect of the present invention is that the receiving head bracket 70 and the receiving foot bracket 72 are provided to receive posts 98 for the patient transport device 100. Further, another important aspect of the present invention is that the rear wheels 30 and 32 are moved away from the seat portion 16, the distance D, toward the back portion 14 when the wheelchair/gurney 10 is in the gurney position 80 so as to provide additional support of the patient to prevent tipping over of the wheelchair/gurney 10. When the wheelchair/gurney 10 is moved into the chair or first position 78, the wheels or casters 30 and 32 are moved toward the seat portion 16 to a distance d so that they are positioned close to the back portion 14 for ease of maneuverability. Further, it is important that all of the casters 28, 30, 32, 34 pivot about axes 90, 90', 90" and 90'", respectively, so that the wheelchair/gurney 10 can be positioned adjacent to a side of a bed or gurney. Axes 90, 90', 90" and 90'" are preferably vertical axes and transverse to the longitudinal axis X'. Axes 90 and 90' are contained in a plane P transverse to axis X'. The casters 28, 30, 32, 34 can also be provided with locks for preventing total movement, as well with locks to prevent pivoting about the axes. These arrangements are known in the art.

Figure 11A:
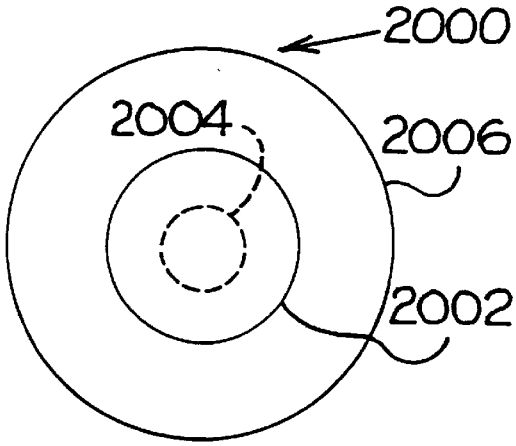
FIG. 11*a* is a bottom view of the plug shown in FIG. 9.
Figure 11B:
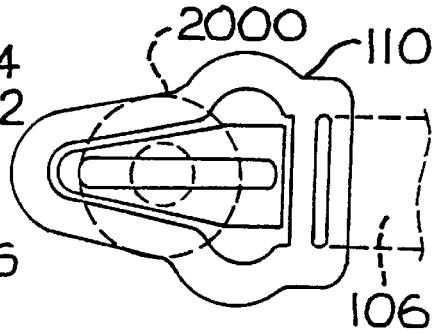
FIG. 11*b* is a top view of a clip.

FIGS. 9–11*a* show a plug 2000 for use with a clip 110 shown in FIG. 11*b*. The plug 2000 includes five circular discs 2002, 2004, 2006, 2008, 2010. Preferably, the plug 2000 is a unitary structure made from a EPDM black, 60 shore hardness, fully cured nonmarking material. Preferably, the circular disc 2010 has a thickness 2012 of between 0.3 inches–0.5 inches. Further, it is preferable that the circular disc 2010 includes sharp corners 2014. Preferably, the other discs have rounded corners 2016 with the exception of a bottom side corner or edge of disc 2002. Preferably, the disc 2008 has a thickness 2018 of between 0.3 inches–0.5 inches. The plug 2000 is used to capture a sheet with the clip 110.

Figure 12:
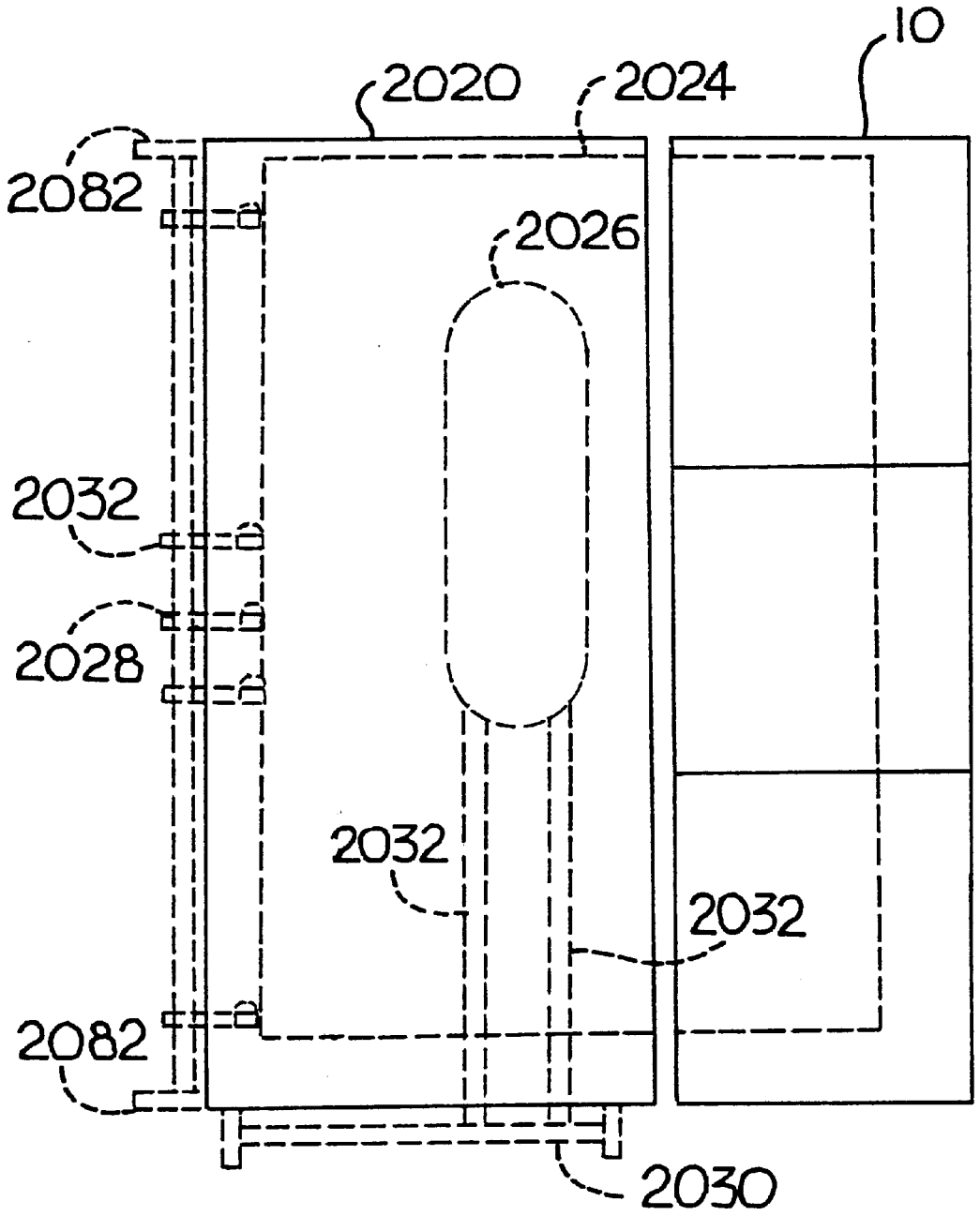
FIG. 12 is a perspective view of a gurney, a bed and a conveyor made in accordance with the present invention.

FIG. 12 shows an arrangement incorporating the present invention and includes a bed 2020 positioned adjacent to the gurney/wheelchair 10. A sheet 2024, shown in phantom, is positioned on upper surfaces of the bed 2020 and the gurney/wheelchair 10. A pad 2026, shown in phantom, is positioned on top of the sheet 2024. A patient transport device 2028 and a patient transport device 2030 are attached to the bed 2020. Straps 2032 are secured to the respective patient transport devices 2028 and 2030.

Figure 13:
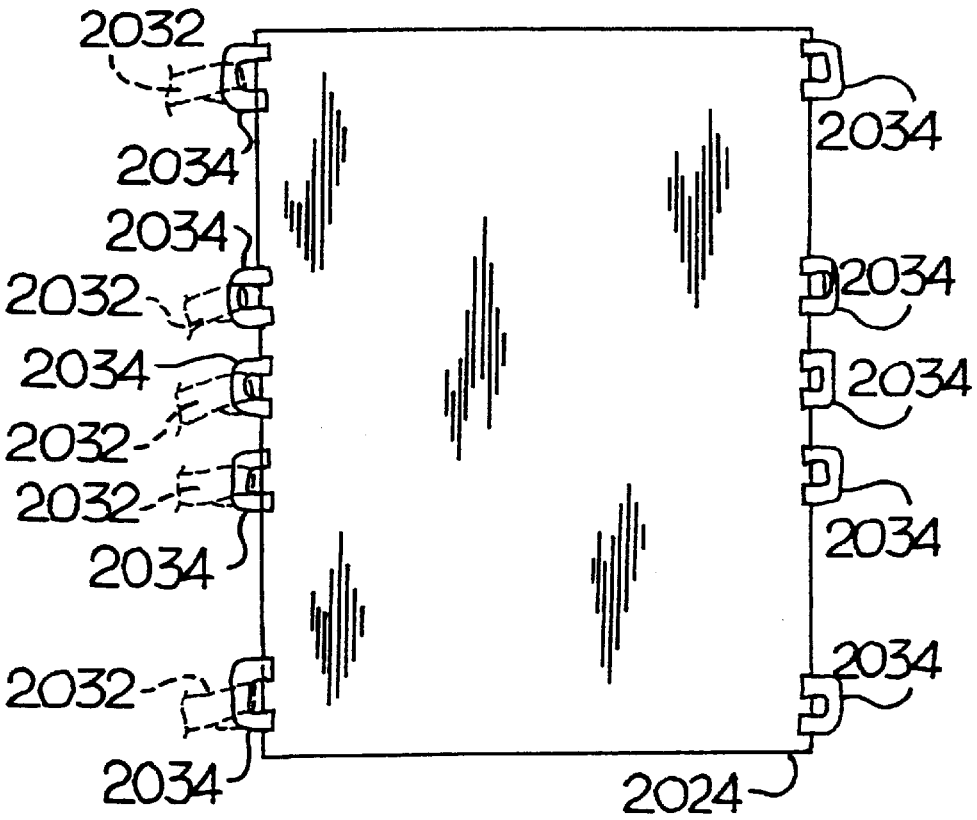
FIG. 13 is a plan view of a sheet made in accordance with the present invention.
Figure 14:
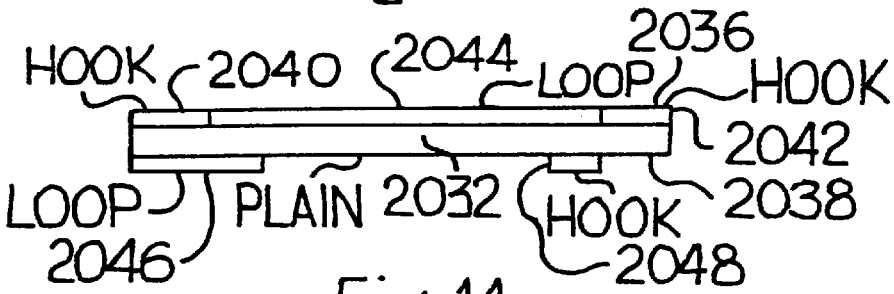
FIG. 14 is a side elevational view of a belt or strap for use with a roller made in accordance with the present invention.
Figure 15:
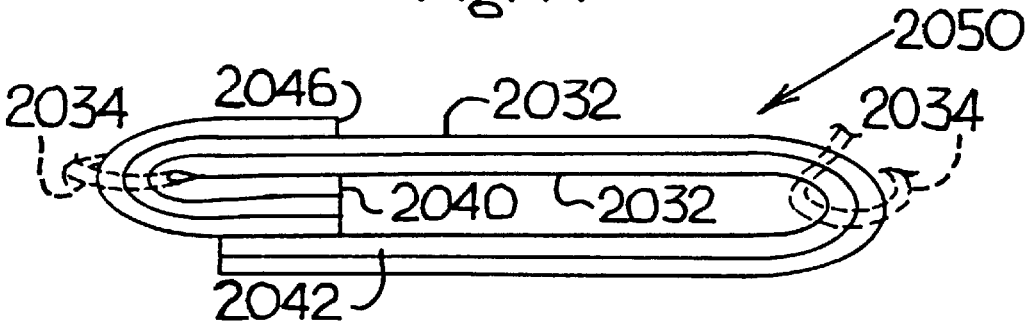
FIG. 15 is a top plan view of the strap shown in FIG. 14.

FIG. 13 shows the sheet 2024. Preferably, the bed sheet 2024 is used with the patient transport devices 2028 and 2030 for home use. In hospital use, regular sheets are preferable. The sheet 2024 includes nylon loops 2034 secured to opposite sides of the sheet 2024. Preferably, ends of the loops 2034 are sewn to the sheet and positioned adjacent the sheet perimeter. Preferably, five loops 2034 are secured to each side of the sheet with one loop 2034 at opposite ends of each side and three loops 2034 positioned along a mid-portion of the sheet 2024. The end loops 2034 correspond to a head and foot position of a patient while the middle loops correspond to the buttocks position of a patient.

FIGS. 14–17 show the strap 2032 made in accordance with the present invention. The strap 2032 includes a front side 2036 and a back side 2038. The front side 2036 includes Velcro fastener hook portions 2040 and 2042. Velcro fastener loop portion 2044 is attached to the front side 2036 between hook portions 2040 and 2042. The back side 2038 includes a loop portion 2046 and a Velcro fastener hook portion 2048 which is offset from an end of the strap 2032. In this arrangement, the strap can be formed into a loop 2050 for securement to the end loops 2034, without the need of a clip 110 and plug 2000.

FIGS. 18–21 show a roller 2052 of the patient transport device 2028 having an hexagonal cross-section. The roller 2052 is primarily a hollow aluminum extrusion and is of a fixed length. A plurality of, in this case five, roller sleeves 2054 having respective stop clips 2056 are slidably received by the roller 2052 and adapted to slide in a longitudinal direction. Collars 2058, 2060 and 2062 are provided on the roller 2052. A cylindrical journal 2064 is positioned between collars 2058 and 2060. A handle 2066, which is slidably received by the roller 2052 is provided adjacent the cylindrical journal 2064. The collars 2058, 2060, 2062 and the cylindrical journal 2064 are welded to the extruded aluminum member. The handle 2066 is removable from the roller 2052 and is similar to handle 104 shown in FIG. 5. A slide journal 2068 is provided. The slide journal includes two collars 2070 and 2072 attached to ends of a cylindrical journal portion 2074. The slide journal 2068 includes a cylindrical bore, so that the roller 2052 slidably passes through the slide journal 2068. In this arrangement, the slide journal 2068 is free to move along the roller 2052. A stop pin 2076 is provided to stop further movement of the slide journal 2068 along the roller 2052.

Figure 22:
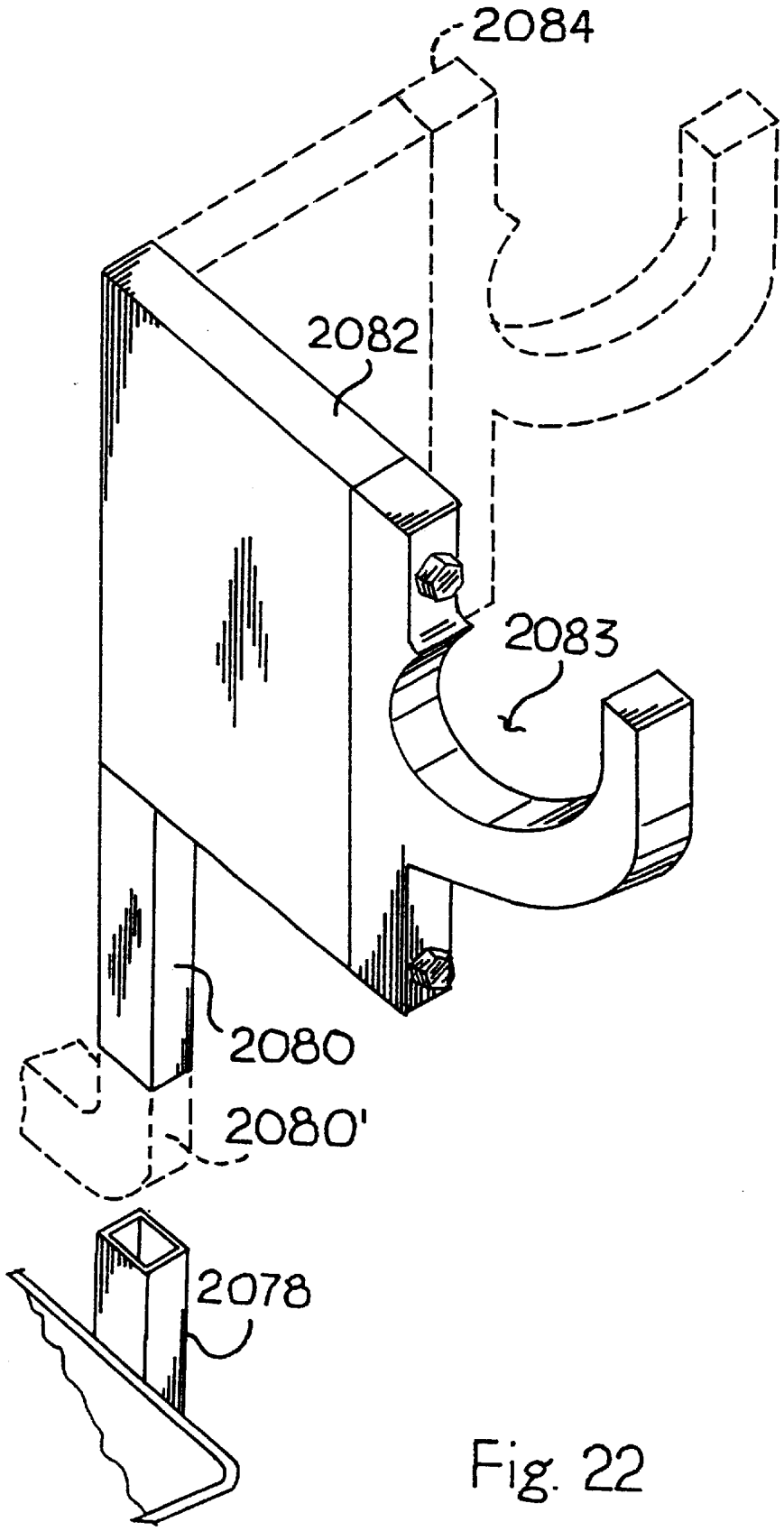
FIG. 22 is a top perspective fragmentary view showing a bearing holder and a post made in accordance with the present invention.

FIG. 22 shows a bearing post holder 2078 and a bearing post 2080 of the patient transport devices 2028 and 2030. Bearing units 2082 and 2084 (shown in phantom and optional) are secured to the bearing post 2080. As can be seen, the bearing post 2080 has a square profile and the bearing post holder 2078 has a likewise square profile. The bearing post 2080 can be received by the bearing post holder 2078 in several orientations for removable and rotatable receipt of the slide journal 2068 and the cylindrical journal 2064 of the roller 2052 by respective bearings attached to the bearing posts 2080. The bearing post 2080 can include an L-shaped extension shown by 2080' for receipt by brackets 70 and 72.

Referring back to FIG. 12, the roller 2052 can be received by respective bearing units 2082 in respective recesses 2083 through the cylindrical journal 2064 and the slide journal 2068. The slide journal 2068 permits an adjustability feature of the roller 2052 to be accepted by various size beds 2020. The slide journal 2068 eliminates the need to provide a telescopic roller as discussed in U.S. Pat. No. 5,996,144. This results in a lightweight roller 2052, that can be easily handled by an elderly caregiver. In the case of the residential bed, I have found that it is preferable to include the loops 2034 and loop the straps around the loops 2034, as shown in FIG. 13. The straps 2032 are secured to the roller sleeves 2054, as previously described. After the patient is on the sheet, he or she can be moved in the manner previously described, adjusting the straps 2032 as necessary.

Figures 16, 17, 18, 19, 20, 21:
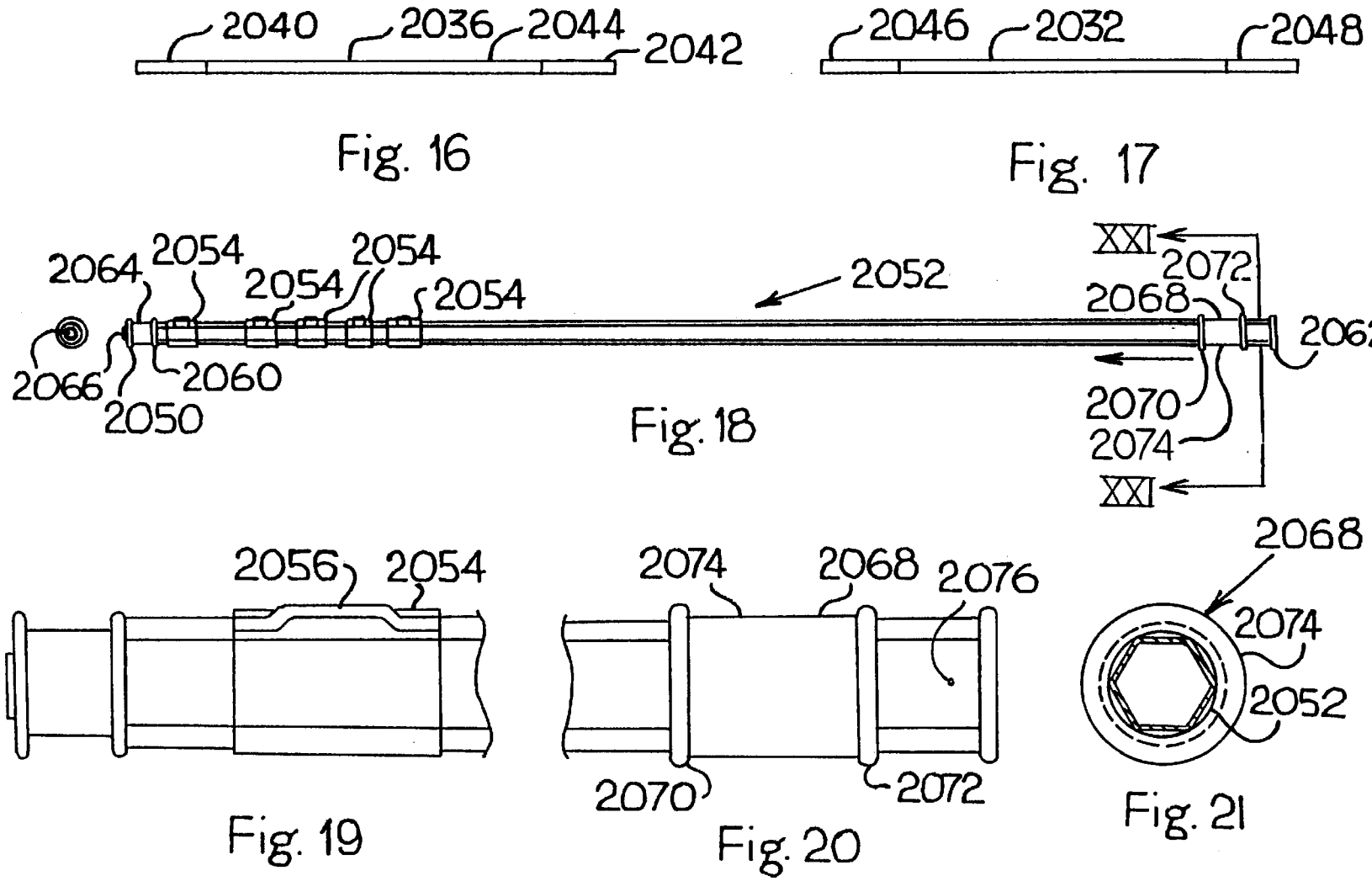
FIG. 16 is a bottom plan view of the belt shown in FIG. 14.
FIG. 17 is a side elevational view of the belt shown in FIG. 14 in an assembled state.
FIG. 18 is a plan view of another embodiment of a roller assembly made in accordance with the present invention.
FIG. 19 is a plan view of a portion of the roller assembly shown in FIG. 18.
FIG. 20 is a plan view of another portion of the roller assembly shown in FIG. 18.
FIG. 21 is a section taken along lines 21-21 of the roller shown in FIG. 18.

Preferably, it is believed that only straps need to be secured to opposite ends of the sheet 2024 and two middle positioned straps 2032 secured at the location of the buttocks of the patient. However, in cases where the patient is obese, three middle straps 2032 may be needed. While moving the patient from a gurney to the bed 2020, the sheet 2024 may become out of alignment. Therefore, the straps 2032 may be adjusted. The loop 2050 shown in FIG. 17 is approximately one-third the length of the strap 2032 in the unlooped position, which is shorter than the previous straps described herein. In some instances, the patient may move from the head or foot of the bed and need to be realigned. In that case, a patient transport device 2030 is provided. Preferably, in this case, the patient is on a pad 2026. The pad 2026 is secured to the patient transport device 2030, similar to those previously described, and moved vertically toward the head or foot of the bed 2020.

Having described the presently preferred embodiment of the invention, it is to be understood that it may otherwise be embodied within the scope of the appended claims.

I claim:

1. A device for use with a base, a patient supporting member attached to the base and a sheet having a first end and a second end, said device comprising:

a roller having a fixed length, said roller having a first end and a second end extending in a longitudinal direction;

two journals attached to said roller, at least one of said journals moveable in the longitudinal direction;

two bearing members, each bearing member adapted to be removably secured to a respective one of said journals of said roller, said journals rotatably secured to respective ones of said bearing members; and means for securing said roller to a sheet.

2. The device as claimed in claim 1, wherein each of said means include flexible straps that are releasably attached to said roller.

3. The device as claimed in claim 1, further comprising a plurality of sleeves slidably secured to said roller and moveable in the longitudinal direction, said sleeves coacting with said means for securing said roller to a sheet.

4. The device as claimed in claim 1, wherein the sheet includes a plurality of loops provided about the perimeter of the sheet.

* * * * *